US005144788A

United States Patent [19]

Varlet

[11] Patent Number: 5,144,788

[45] Date of Patent: Sep. 8, 1992

[54] METHOD OF VACUUM-PACKING A LIQUID OR A PASTE IN A FLEXIBLE TUBE HAVING A DISPENSING PUMP OR VALVE

[75] Inventor: Jean-Pierre Varlet, Le Neubourg, France

[73] Assignee: Valois S.A., France

[21] Appl. No.: 372,742

[22] Filed: Jun. 28, 1989

[30] Foreign Application Priority Data

Jun. 28, 1988 [FR] France ..... 88 08653

[51] Int. Cl.[5] ..... B65B 31/00; B65B 61/00

[52] U.S. Cl. ..... 53/434; 53/410; 53/469; 53/479

[58] Field of Search ..... 53/242, 243, 410, 432, 53/434, 469, 473, 86, 88, 479, 405, 433, 510, 511, 512; 141/113; 215/2

[56] References Cited

U.S. PATENT DOCUMENTS

| | | | |
|---|---|---|---|
| 2,241,943 | 5/1941 | Berch | 53/433 |
| 2,503,171 | 4/1950 | Power | 53/469 X |
| 2,530,400 | 11/1950 | Rado | 53/469 |
| 3,220,161 | 11/1965 | Lohse et al. | 53/373 |
| 3,297,207 | 1/1967 | Ballin | 53/469 X |
| 3,325,969 | 6/1967 | Bemiss et al. | 53/373 |
| 3,531,908 | 10/1970 | Rausing et al. | 53/469 X |
| 3,545,983 | 12/1970 | Woods | 53/433 X |
| 3,634,099 | 1/1972 | Wilson | 53/433 X |
| 4,025,046 | 5/1977 | Boris . | |
| 4,081,942 | 4/1978 | Johnson | 53/407 |
| 4,363,205 | 12/1982 | Hollander, Jr. | 53/469 X |
| 4,511,426 | 4/1985 | Linnér | 53/477 X |
| 4,730,439 | 3/1988 | Chung et al. | 53/434 X |
| 4,794,750 | 1/1989 | Schmidt et al. | 53/410 |
| 4,845,927 | 7/1989 | Rapparini | 53/511 |

FOREIGN PATENT DOCUMENTS 2305241 4/1971 France .

*Primary Examiner*—John Sipos
*Assistant Examiner*—Linda B. Johnson
*Attorney, Agent, or Firm*—Sughrue, Mion, Zinn Macpeak & Seas

[57] ABSTRACT

A method of packaging a liquid or a paste in a flexible tube comprising a bottom (14) and a head provided with a dispensing valve (10), comprises at least the following steps: 1) the liquid or paste (13) is inserted into the tube via its bottom (14); and 2) an air vacuum is established inside the tube, and the tube is the closed in sealed manner by welding its bottom (14). Advantageously there is an intermediate step of initially welding the bottom of the paste-filled up-side-down tube only in part. Then, during step 2), after the air has been evacuated, the weld is immediately finished off. In this preferred implementation of the present invention, step 2) is preferably entirely performed by means of apparatus (50) comprising two groups of parts slidably mounted relative to each other and mounted on a press (90) which is connected to a vacuum pump (91). When the bottom notch (51) of the apparatus presses down on the partially-welded bottom (14) of an up-side-down tube (12) in a support (20) which also serves as an abutment for the bottom group (52) of parts, continued downwards displacement of the top group constituted by cylinders (70, 75, and 80), causes a cam (72) and balls (63) to open a valve (57) through which air is sucked out, and then rapidly clamps together jaws (54).

11 Claims, 4 Drawing Sheets

FIG.1
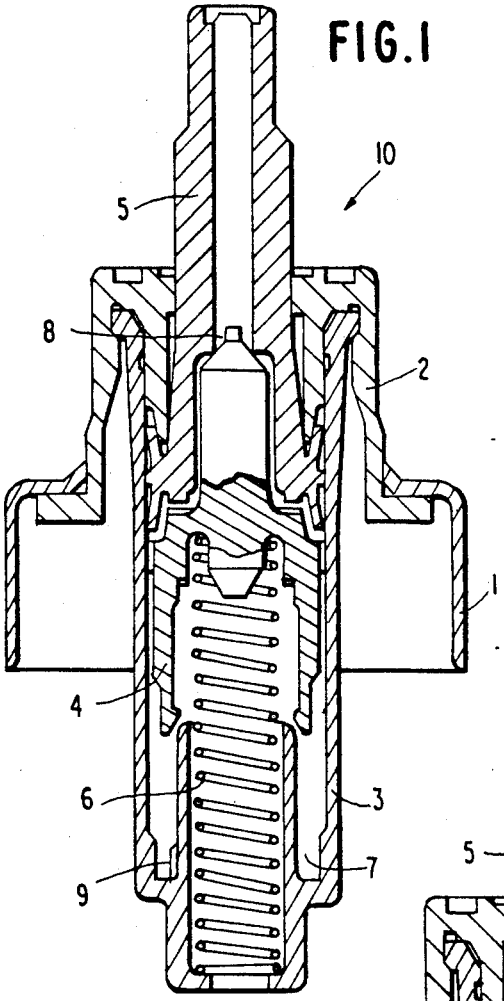
FIG.2
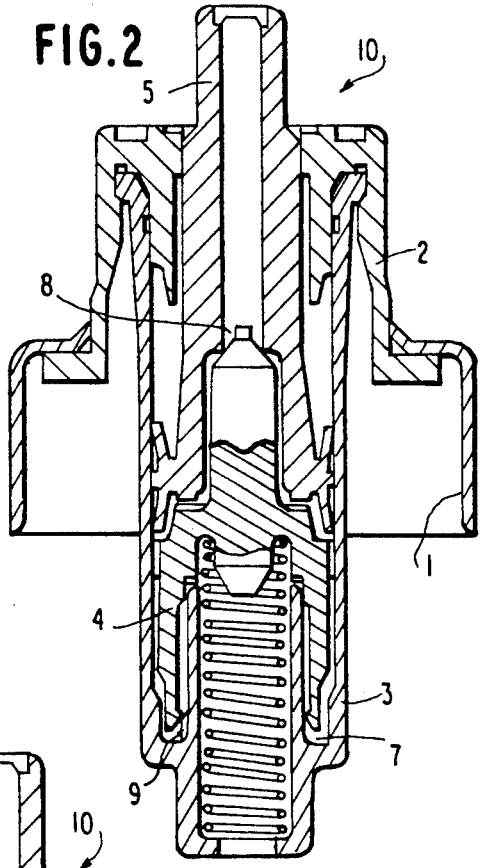
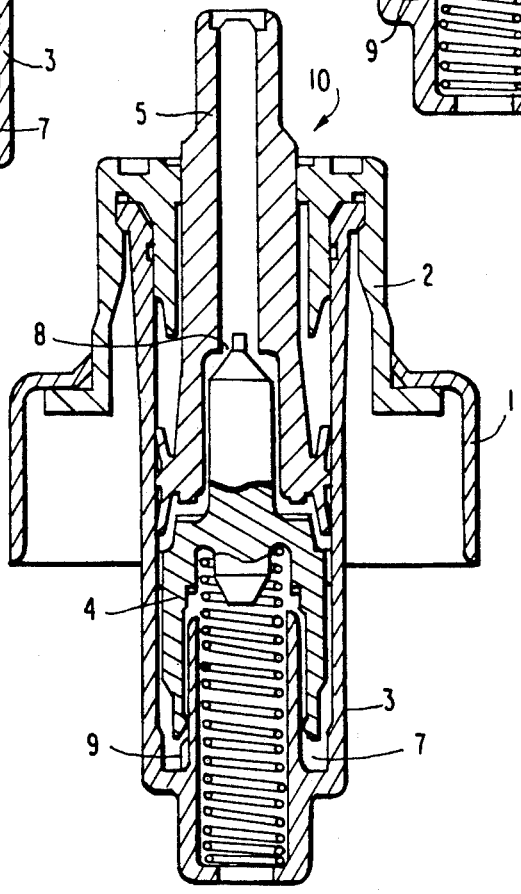
FIG.3

FIG. 8
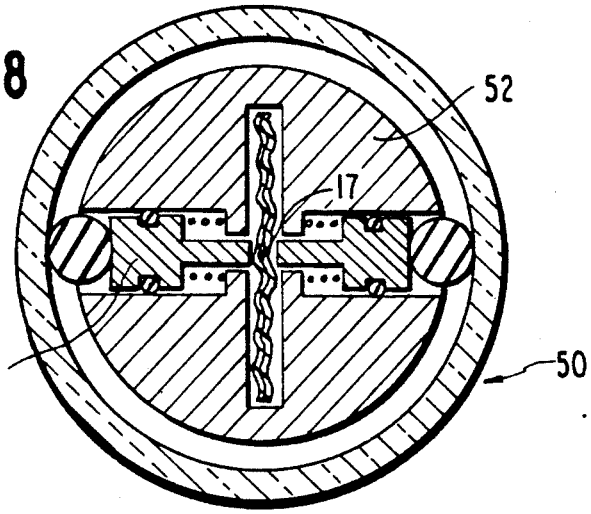
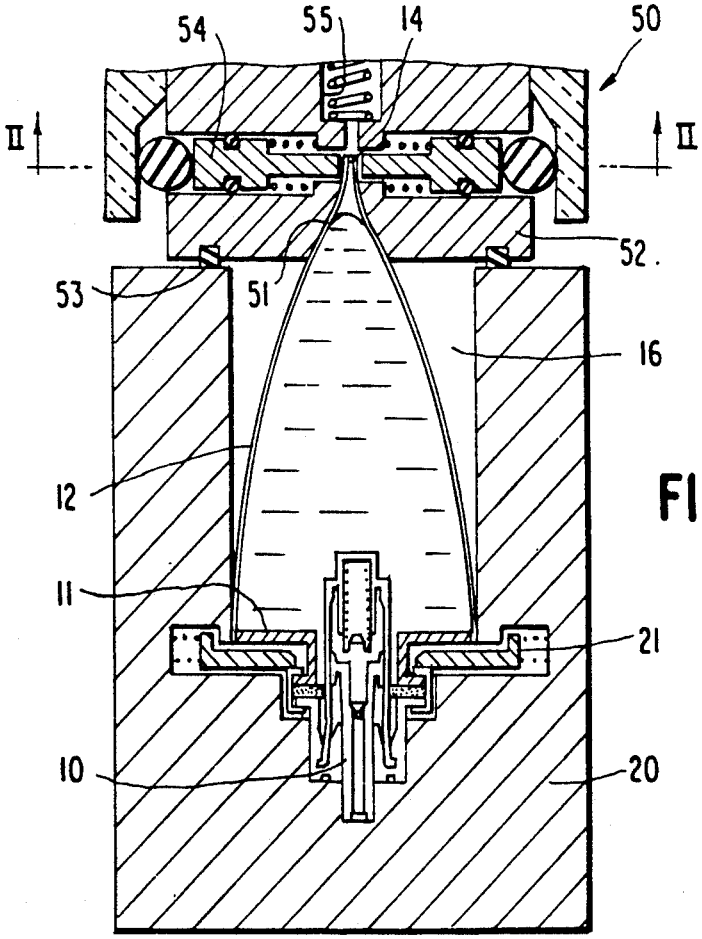
FIG. 7

METHOD OF VACUUM-PACKING A LIQUID OR A PASTE IN A FLEXIBLE TUBE HAVING A DISPENSING PUMP OR VALVE

The present invention relates to tubes of paste used for dispensing cosmetic or pharmaceutical substances such as face creams, suntan lotions, toothpaste, ointments, etc. The pastes are fluid to a greater or lesser extent, and the tubes are provided with dispensing valves comparable to those commonly provided on perfume sprays, for example. The tubes are made of relatively flexible plastic material and the bottoms of the tubes are closed by welding, giving such tubes their well-known appearance. However, tubes of the present invention differ from many comparable forms of packaging in that air is evacuated from the tubes immediately prior to their being welded. The invention relates specifically to a method of performing such tube-closing welding while substantially evacuating the air from the tube. The invention also relates to apparatus suitable for implementing the method.

BACKGROUND OF THE INVENTION

Flexible tubes currently used for dispensing pastes do not generally have a dispensing valve. However it is very advantageous to provide such a valve, particularly if special valves known as precompression metering pumps are used. A particularly advantageous improvement of such valves is described in French patent number 2 305 241 (1975) enabling them to operate in any orientation relative to the vertical. One example of such an improved prior art pump is shown in various different positions in FIGS. 1 to 3.

Each of these figures is in vertical section and shows six different parts. Three of these parts are fixed relative to one another namely: a crimping cup 1 for sealing the valve assembly 10 to the neck of a paste-containing receptacle (not shown) in sealed manner; a turret 2 for placing on the outside of the receptacle; and a body 3 whose bottom end is immersed in the support of paste. The other three parts are mounted to slide vertically within the body 3, and comprise: a hollow piston rod 5; a double-ended valve member 4; and a return spring 6. In FIG. 1, the parts are in a configuration which corresponds to the rest position with the valve closed. Without going into full detail of pump operation, it is recalled merely that depressing the piston rod 5 compresses fluid trapped in pump chamber 7. When the compression overcomes the opposition of the spring 6, the fluid opens a passage 8 and escapes. The various parts are then in the relative positions shown in FIG. 3 where the valve is shown open.

Such a valve gives three qualities to a tube of paste. As a pump it ensures that at least 95% of the substance contained in the tube can be dispensed in use. Its metering function is particularly advantageous for pharmaceutical substances, but may be advantageous in other applications as well. Finally, precompression is essential for safety reasons in some applications, and in any application it ensures clean operation. The pressure that must be reached inside the chamber 7 so as to open the passage 8 is much higher than the pressure which can be set up inside the tube by squeezing it by hand. This greatly reduces any danger of substance being dispensed accidentally.

However, the use of such precompression metering pumps for dispensing paste encounters a problem with priming. When the valve is crimped onto the tube of paste, its chamber 7 contains air. When the piston rod 5 is depressed for the first time, this air compresses. However, as a gas, the air cannot reach a sufficiently high pressure to escape via the passage 8. That is why the body 3 is normally provided with a short spline 9. The skirt of the valve member 4 can then be caused to lift slightly away from the inner cylinder, thereby opening a passage to allow the air to escape into the receptacle (see FIG. 2). Although this system is effective at priming the pump when the tube contains a liquid, it is ineffective when the tube contains a paste because of the viscosity of the paste, since the air expelled into the supply of paste tends to remain close to the chamber 7 in the form of a bubble. When the piston rod 5 and the valve member 4 move back up, the same air is sucked back into the pump chamber 7 instead of the paste, as desired. This means that it is practically impossible to prime the pump.

French patent application number 2 625 729 describes a tube provided with a precompression metering pump, but overcomes this drawback by means of a tube whose wall is semi-rigid and by ensuring that there is sufficient initial pressure inside the receptacle. However, this requires specially-shaped tubes or flasks to be used. From an economic point of view it is more advantageous to continue using flexible tubes, as is the common practice. The object of the present invention is therefore to solve the problem of priming pumps used for dispensing pastes from flexible tubes.

The invention is based on the idea of establishing a vacuum inside the paste-containing tube. Present methods for obtaining such a vacuum in receptacles that are to be closed by a dispensing valve are essentially designed to operate with rigid flasks. They include a step of placing the valve on the flask by means of a device which bears against the walls of the receptacle, thereby sealing off a chamber. Air can then be sucked out from the chamber and the valve put immediately into place and then crimped on. No method has been proposed for flexible tubes other than welding through the substance they contain. However, this method which is used for example to split up a bleach-containing cylinder sausage-like into individual sachets, cannot be performed in the presence of pastes containing fat or grease.

SUMMARY OF THE INVENTION

The present invention provides a method of packaging a liquid or a paste in a flexible tube comprising a bottom and a head provided with a dispensing valve, the method comprising at least the following steps:

1) said liquid or paste is inserted into said tube via its bottom; and 2) an air vacuum is established inside said tube, and said tube is then closed in sealed manner by welding its bottom.

The dispensing valve is advantageously a precompression metering pump. It is preferably mounted on a neck which is bonded to the tube by crimping or by overmolding.

In order to perform this method industrially, a support may be provided for receiving the tube in a head-down or "up-side-down" position. The support advantageously includes means for keeping the dispensing valve in a position such that it contains as little air as possible. The tube can thus be transported from one work station to another in a machine suitable for performing the various steps of the method automatically.

The step of inserting the substance is then performed by means of a spout connected to the machine and having a bottom end which is moved relative to the tube as the quantity of substance already inserted increases, thereby ensuring that the bottom end of the spout stays above the surface of the substance.

Advantageously, the method includes an intermediate step of welding the bottom of said paste-filled tube in part, after which an air vacuum is set up in the tube by the last step of said method, and finally the welding at the bottom of the tube is completed. After the tube has been preheated, the step of welding the bottom of the tube in part is preferably performed by means of jaws including a central notch such that when clamped against the bottom of said tube they close it along its entire length except for a small passage left in the middle of the bottom. During the last step of the method, air is sucked out through said small passage left in the incompletely welded end of the tube, after which the passage itself is welded shut in turn. Advantageously, the passage is welded between one tenth of a second and one second after air suction has commenced. The passage may be welded ultra-sonically or thermo-mechanically by heating the bottom of the tube prior to implementing said last step of the method.

An apparatus is proposed for automatically performing the last step of the method of the invention after an intermediate step of welding the bottom of the tube in part has been performed. The apparatus comprises two groups of parts capable of moving in vertical translation relative to each other when a vertical force is exerted against resilient means interposed therebetween:

the first group of parts comprising: a vertical axis cylindrical part having an upper portion provided with a hollow cylinder about the same axis as the axis of said part, said hollow cylinder having a throat constituting the seat of a valve; a lower portion including a notch disposed symmetrically about a horizontal axis intersecting the axis of said cylindrical part and serving to guide the bottom of an upsidedown tube; and about halfway between said upper and lower portions, two horizontal cylindrical recesses disposed symmetrically about the axis of said notch, passing through said cylindrical part from side to side, and each suitable for receiving a corresponding jaw projecting into said notch, each jaw being connected in air-tight manner to said cylindrical part and being capable of sliding relative thereto under the combined effects of a return spring and a thrust ball;

the second group of parts comprising: a skirt whose inside surface fits the vertical outside surface of said cylindrical part firstly to provide an end-of-stroke abutment therefor, and secondly to thrust said balls into said recesses in said cylindrical part progressively by means of a cam; and also a cylinder rigidly connected to said skirt and provided with a central channel terminating in a needle suitable for engaging in air-tight manner inside the throat of said hollow cylinder of said cylindrical part, thereby opening said valve; and said first group of parts is suitable for co-operating with said support in order to form a sealed chamber therewith, from which air is evacuated, while the second group is compatible with a head of said automatic machine for transmitting said vertical force and for pumping the air.

As the above summary of the invention makes clear, tubes manufactured in this way may also contain liquids, or they may have valves which are less sophisticated than the above-mentioned metering pumps. In any event, problems associated with valve priming are solved by the air vacuum that is established. Atmospheric pressure bearing against the walls of the flexible tubes provides all the energy required for filling the pump chamber with the substance contained in the tube, even when that substance is a viscous paste. Another advantage of the invention is that the content of the tube is not contaminated by contact with air, e.g. by polluted air or by oxygen in the atmosphere.

The advantage from a practical point of view of the intermediate step during which the bottom is welded in part, is clear. It greatly reduces the quantity of air that subsequently needs to be pumped out. For the same reason, the apparatus of the invention preferably has the valve for putting the air pumping system into communication with the bottom of the tube located as close as possible to the bottom of the tube.

The method and apparatus of the present invention are described below with reference to the drawings. The essential function of the drawings is to assist in comprehension, and the invention is not limited to the specific embodiments shown therein. In particular, it has already been emphasized that the dispensing valve placed on the flexible tube could very well be of a type different from that mentioned so far. Similarly, the invention is equally applicable to liquids. Nevertheless, the example illustrated uses a precompression metering pump for delivering a paste, as originally discussed.

BRIEF DESCRIPTION OF THE DRAWINGS

Embodiments of the invention are described by way of example with reference to the accompanying drawings, in which:

FIG. 1 is a vertical section through a prior art precompression metering pump suitable for placing on flexible tubes which are subsequently welded under an air vacuum by means of the method of the invention, with the metering pump being shown in its closed, or rest position in this figure;

FIG. 2 is a section similar to FIG. 1 showing the metering pump in its priming position;

FIG. 3 is a further section showing pump operation for dispensing paste;

FIG. 7 is a vertical section comparable to FIGS. 4 and 5 showing the last stage of welding in one implementation of the method of the invention;

FIG. 8 is a horizontal section on plane II—II of FIG. 7; and

DETAILED DESCRIPTION

Figure 4:
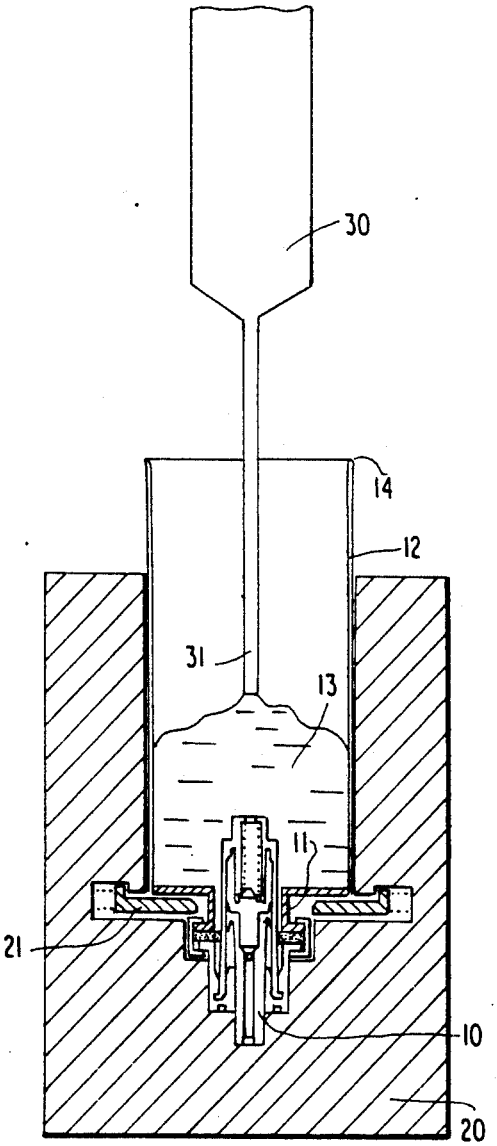
FIG. 4 is a vertical section through a tube fitted with a metering pump and being filled in accordance with an implementation of the method of the present invention.
Figure 6:
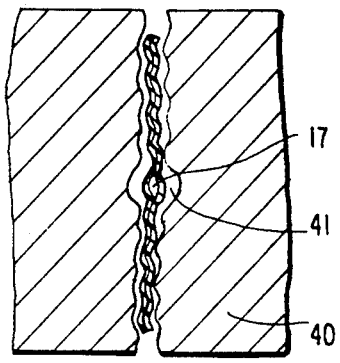
FIG. 6 is a horizontal section on plane II of FIG. 5.
Figure 5:
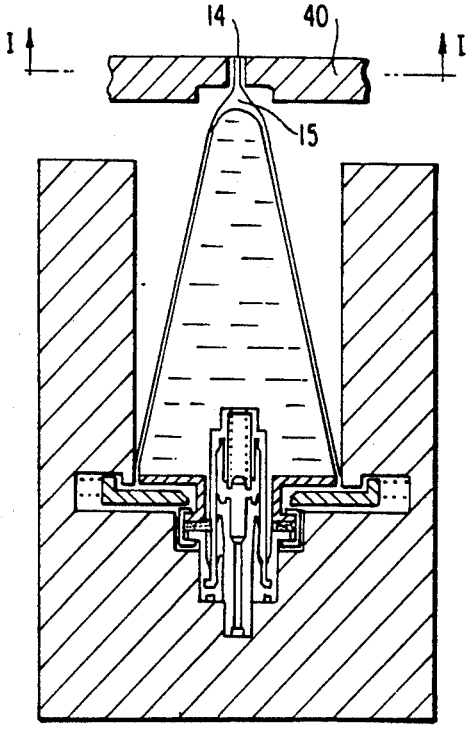
FIG. 5 is a vertical section similar to FIG. 4 showing the stage during which the bottom of the tube is welded in part while performing the method of the invention.

The method of welding over an established air vacuum in a tube of paste is described with reference to FIGS. 4 to 8. The method is implemented using a machine which performs the various steps of the method automatically. In order to facilitate this automation, a tube 12 of flexible plastic material is initially cut to the desired length. It is then welded onto a generally cylindrical part 11 constituting the neck of the future tube of the paste. A precompression metering pump 10 as described above can then be fixed in sealed manner on the neck 11. FIGS. 4, 5, and 6 show a metering pump 10 having a metal cup which is crimped onto the neck 11. However, it will be equally possible to fix the pump 10 by overmolding onto the neck 11. The assembly constituted by the pump 10 and the cylinder 12 is then placed on a support 20 which constitutes a portion of the above-mentioned machine. This support 20 is made of metal or of plastic and has an internal housing for receiving the assembly with the pump 10 being at the bottom thereof and with the cylinder 12 being open at the top. This housing is provided with means 21 suitable for forcing the valve of the metering pump 10 to take up its fully-depressed position as shown in FIG. 2. These means 21 are constituted, for example, by metal tongues suitable for sliding over a stroke of defined length inside horizontal recesses formed in the support 20 and containing return means. When the pump-cylinder assembly is inserted into the support, the pump 10 is pressed against the bottom of the housing so as to push home its piston rod. The tongues 21 which retracted automatically into the support 20 as the pump went past them, extend under thrust from their springs and hold the pump in place. In this position, the chamber 7 is reduced to minimum volume so that the valve contains as little air as possible. However, it is explained below that so long as the pump and cylinder cannot escape easily from the support 20, it is not absolutely essential to keep the pump in its fully-depressed position.

The first stage of the method consists in filling the cylinder 12 with paste 13. This is preferably done by means of an injection system 30 provided with a relatively long spout 31. During filling, the bottom end of the spout is kept close to the surface of the paste so as to avoid trapping air bubbles therein. This means that the spout must move relative to the cylinder 12 so as to keep pace with the quantity of paste injected into the cylinder 12. For example the spout may be raised.

Thereafter, the support 20 is moved away from the injection system 30. In a particularly advantageous first implementation of the present method, the support 20 is then moved beneath a welding station. As it moves, the top edge 14 of the cylinder 12 remains close to a heater strip which is not shown in the figures. The function of the heater strip is to keep the plastic material at a suitable temperature for a welding operation. The welding is performed in conventional manner by means of jaws 40 which are preferably made of metal and which clamp horizontally against the cylinder 12 close to its top edge 14, thereby pressing together the two lips formed in this way, as shown in FIG. 5. The jaws 10 may themselves be provided with heater elements for the purpose of welding the lips together thermomechanically. It is then possible to omit an intermediate heater strip. In this preferred implementation of the present invention, the jaws 40 have relatively deep notches 41. These notches are preferably situated in the middle of the jaws (see FIG. 6) and extend over their entire thickness. As a result, when the bottom of the upsidedown tube is welded together, it is closed only in part: a small-sized passage 17 still provides communication between the inside of the tube and the atmosphere. That is why this stage of the method is sometimes referred to as the "prewelding" step.

The support 20 is then again moved relative to a work station (this time the prewelding station 40) and the edge 14 of the cylinder 12 now constituting the bottom of the upside-down tube is again advantageously kept close to a heater strip. The assembly is then positioned beneath an apparatus 50 specially designed for finishing off the welding of the bottom of the tube and for evacuating any air that may still remain inside the tube (e.g. space 15). Prior to describing the apparatus in greater detail, its operation is explained with reference to FIGS. 7 and 8. The bottom 14 of the upsidedown tube is initially engaged in a guide 51 at the bottom 52 of the apparatus 50, until the bottom portion 52 comes into abutment against the surface of the support 20. A gasket 53 then seals off the chamber 16 established in this manner. Simultaneously, the prewelded bottom 14 of the upsidedown tube comes level with two jaws 54. The apparatus 50 is designed in such a manner as to be capable of performing the following two operations consecutively but very close together in time (e.g. 1/10th of a second to 1 second apart):

1) air is sucked up via channel 55 so as to evacuate both the chamber 16 and the residual space 15 inside the tube; and 2) the jaws are pressed against each other, thereby closing off the passage 17 and completing the welding at the bottom 14 of the upsidedown tube.

It may be observed that the jaws could be replaced by an anvil and a sonotrode so as to perform this welding operation ultrasonically. In the event, the paste 13 is thus in a vacuum inside the flexible tube, and the tube is completely air-tight. When the means 21 are actuated to release the tube (e.g. by means of an electromagnet), the piston rod of the pump moves out from the tube, thereby causing the pump chamber to fill automatically with paste. In other words, the precompression metering pump is already primed.

If there are no means 21 for holding the pump fully depressed throughout the method of the present invention, priming can still be performed. The atmospheric pressure surrounding the flexible tube transmits sufficient pressure to the paste to enable it to fill the pump chamber. Indeed, this pressure could theoretically be used to avoid the need for a pump for dispensing the paste. A mere valve would suffice providing the vacuum was high enough and there was no special need to empty the tube completely at the end of use. Finally, there is nothing to prevent the method from being applied to a tube containing a liquid.

Figure 9:
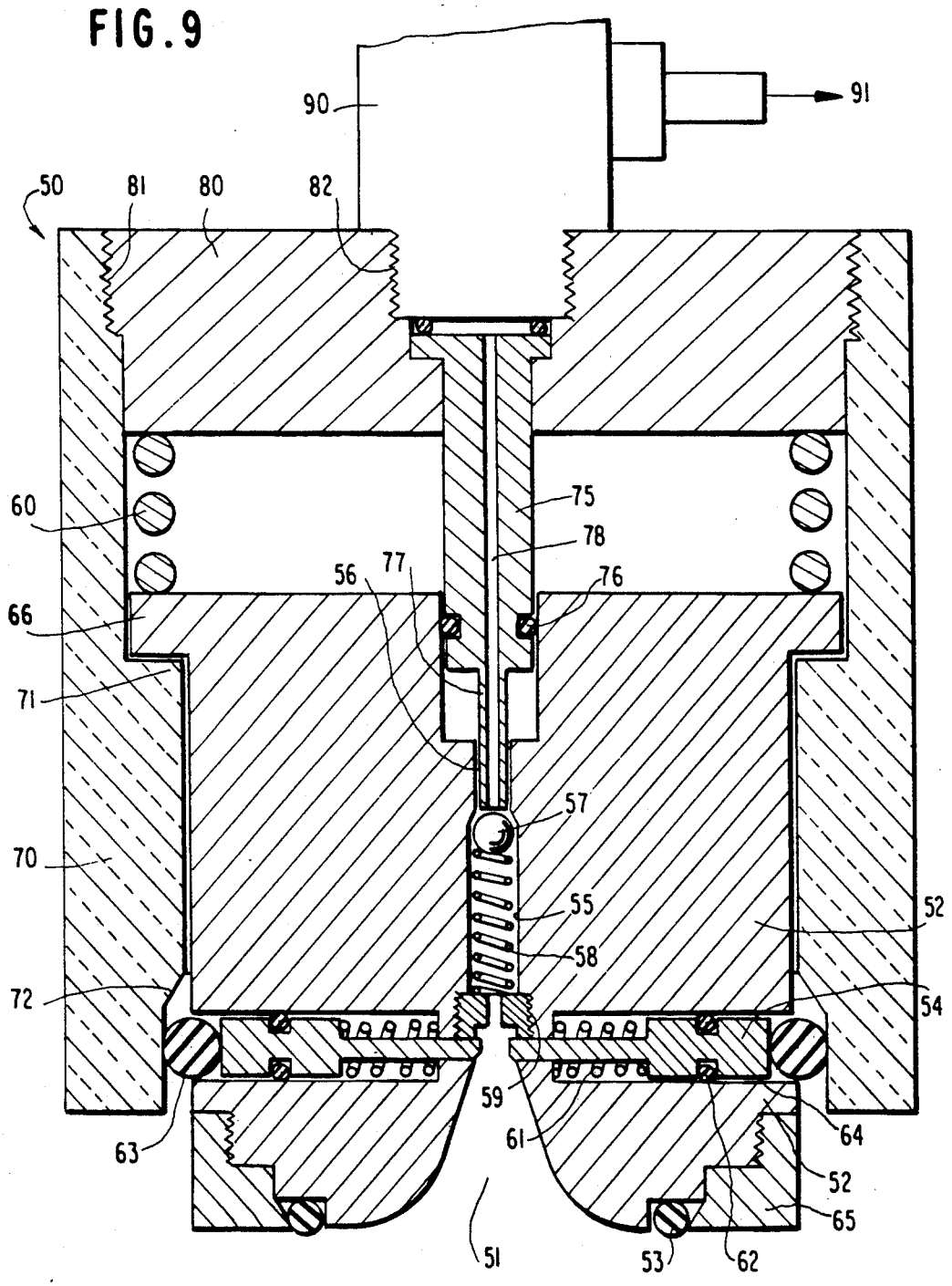
FIG. 9 is a vertical section through apparatus in accordance with the invention.

One embodiment of the apparatus 50 suitable for performing the last welding step is now described with reference to FIG. 9. It comprises two groups of parts both of which are preferably made of metal and which are capable of moving relative to each other in vertical translation. When no force is applied to them, they are kept at a maximum distance apart from each other by means of a spring 60. The bottom group of parts is essentially constituted by a cylindrical part 52 having two internal voids of relatively complex shape. Near the top it has a hollow cylinder 55 about the same axis as the axis of the cylinder part 52. The hollow cylinder 55 is of varying cross-section. In particular, it has a throat 56 which acts as a valve seat. A ball 57 is pressed against the throat 56 by a spring 58 which is inserted via the base of the hollow cylinder 55 and held in place by a nut 59. A cylindrical channel through the center of the nut 59 puts the hollow cylinder 55 into communication with a horizontal notch formed in the bottom portion of the cylindrical part 52. The shape of the notch is suitable for engaging the bottom of the upsidedown tube to be welded. It consitutes the above-mentioned guide 51. At the top of the guide 51, but beneath the nut 59, two horizontal jaws 54 project symmetrically relative to the guide. These jaws are received in cylindrical recesses 64 provided through the thickness of the part 52 (see FIG. 8). Each of them has a shoulder against which a spring 61 bears. The springs serve to urge the jaws, in the absence of externally-applied force, so as to retract them into the part 52. Each jaw 54 is also provided with a gasket 62 providing an air-tight connection between each jaw and the cylindrical part 52. At the periphery of the part 52, each of the recesses 64 has a ball 63 received therein so as to come into abutment with a corresponding one of the jaws 54 and oppose the springs 61. Finally, a sealing ring 53 is held in place at the bottom of the part 52 about the axis of the part, by means of a removable ring 65.

The other group of parts comprises two main elements. Firstly there is a skirt 70 which fits around the outer vertical wall of the cylindrical part 52. Although the outside surface of the skirt 70 is smooth, its inside surface is more complex in shape. Firstly it has a shoulder 71 for co-operating with a flange 66 projecting from the top of the cylindrical part 52 for abutment purposes. Thereafter, and at about the same height as the jaws 54, the inside of the skirt expands progressively in a cone-shape constituting a cam 72. Thus, when the skirt 70 slides over the part 52, each ball 63 is cammed by the cam 72 to a greater or lesser extent into the corresponding recess 64 causing the corresponding jaw 54 to extend to a greater or lesser extent into the guide 51.

In addition, a cylinder 75 is capable of engaging vertically into the hollow cylinder 55 of the cylindrical part 52. The corresponding connection is sealed by a sealing ring 76. In order to engage the above-mentioned throat 56, the cylinder 75 is terminated at its bottom end by a needle 77. When the cylinder 75 slides inside the part 52, the ball 57 is thus pushed against the spring 58 towards the nut 59 by the needle 77. It should be observed that the cylinder 75 has a narrow inside channel 78.

The cylinder 75 and the skirt 70 are rigidly connected to each other by a third part 80 in the form of a hollow cylinder which is threaded on both its inside and outside surfaces. The outer thread 81 is used for fixing the skirt 70, and the inner thread 82 is used for assembling the entire apparatus 50 to the machine for implementing the welding method of the invention automatically. FIG. 9 includes an elevation of a portion of a head 90 of said machine, which head provides a connection to a vacuum pump 91. The pump may operate continuously throughout the various stages of the method of the invention, and there is no need for it to be a particularly high-performance pump, since negative pressures of about 0.5 bars suffice.

The head 90 is also connected to an actuator or other mechanical control device enabling it to be displaced vertically. When the apparatus is pressed down in this way onto the prewelded bottom 14 of an upsidedown tube contained in a support 20, the sealing ring 53 rapidly encounters the top surface of the support. Thereafter, the part 52 is pressed against the support, thereby sealing off the chamber 16.

As the head 90 continues to move downwards, it opposes the spring 60, and the skirt 70 and the needle 77 slide relative to the cylindrical part 52. The first result of this is to thrust the ball 57 into the hollow cylinder 55. The chamber 16 and the inside 15 of the tube (see FIGS. 5 and 7) are thus put into communication with the vacuum pump 91 and air is removed therefrom. The second effect is for the balls 63 to be pressed in by the mechanism described above. Consequently, the two jaws press against each other pinching off the bottom 14 of the upsidedown tube and welding it where the passage 17 had previously existed (see FIG. 6). The time interval between these two effects depends on the length of the needle 77 relative to the rate of change of the inside section of the skirt 70. When the head is raised again, it begins by raising the skirt 70 and the needle 77, thereby allowing the jaws to retract, and then allowing the valve 57 to close. Finally, the part 52 is raised, thereby releasing the tube which is now sealed and ready for further finishing operations (e.g. having a pushbutton assembled thereto, packaging, . . . ).

In another implementation of the present method, the prewelding step is omitted. As soon as the upsidedown tube in the support 20 has been filled with paste 13, the support and tube assembly is immediately disposed beneath a work station capable of evacuating the air from the tube and then of welding together the entire bottom of the upsidedown tube. As before, a system of heater strips makes it possible to keep the bottom of the upsidedown tube at an appropriate temperature while it is travelling from the filling work station to the final welding station. Thereafter, the welding station performs the following operations in sequence:

1) the open end 14 of the tube which is initially circular in shape is deformed so as to constitute two lips, and the lips are moved towards each other;

2) air is sucked out through the slot remaining between the two lips of the deformed edge 14; and 3) the two lips are welded together.

The apparatus enabling these three operations to be formed very quickly one after the other is not shown in the drawings. It may be designed in numerous different ways. However, in order to demonstrate feasibility, one possible way of designing it is outlined. The apparatus is similar to the apparatus 50 shown in FIG. 9 for performing the first implementation of the method of the invention. Essentially it is only the bottom portion 52 of the apparatus 50 that needs to be altered. For example, the notch 51 needs to be flared to a greater extent, and the sealing ring 53 must be larger in diameter. The bottom part 52 of the apparatus can then be presented immediately over the support 20 in such a manner as to cause the circle initially constituted by the edge 14 of the upsidedown tube to be fully engaged within the notch 51. As the apparatus moves down towards the support 20, the circle is pushed further therein and the walls of the notch contribute to deforming the edge 14 of the tube progressively. Finally, when the apparatus makes contact with the support 20, the edge 14 has taken up the shape of two facing lips.

Simultaneously, a chamber comparable to the chamber 16 of FIG. 7 is isolated from the surrounding atmosphere. A vacuum can then be set up therein in a manner similar to the above-described first implementation by mechanically opening a valve 57 between the chamber and a vacuum pump 91. In the new apparatus, this is done, for example, by the same set of parts as are provided in the apparatus 50 above the jaws 54. In which case, the valve is opened by the head 90 continuing to move down towards the support 20.

The new apparatus also needs to be provided with welding means capable of welding the two lips formed from the edge 14 together over their entire length. These means are not necessarily mechanical. They could then be actuated by a signal (e.g. an electronic signal) emitted after an appropriate period of time from the instant that the valve opens. However, in order to obtain more reliable operation it is preferable for the welding means to be mechanically triggered by the continuing descent of the head 90. It would also be possible to make use of jaws displaced by a cam system. However the jaws would then need to press against the full extent of each of the lips made from the edge 14.

I claim:

1. A method of packaging a non-gaseous fluid in a flexible tube having a bottom as well as a head which is provided with a dispensing valve, the method comprising at least the following steps:

(1) placing said tube upside down on a support having the form of a topless housing so that a bottom of said tube is on an open side of said support, (2) inserting said fluid into said tube via said bottom, (3) welding the bottom of said filled tube in part, (4) imperviously closing said support in order to form a sealed chamber therewith, (5) establishing an air vacuum and consecutively sealing said tube by completing the welding of said bottom of said tube inside said sealed chamber, and (6) opening said support and releasing said tube.

2. A method according to claim 1, wherein said dispensing valve is a precompression metering pump.

3. A method according to claim 1, where said dispensing valve is fixed to said tube by crimping or overmolding onto a neck welded onto said tube.

4. A method according to claim 1, wherein said support forms a part of a machine suitable for implementing the method automatically.

5. A method according to claim 1, wherein said support includes means for keeping said dispensing valve in a position in which it contains as little air as possible.

6. A method according to claim 4, wherein the step of inserting said fluid is performed by means of a spout fixed to said machine and having a bottom end which is moved relative to said tube as fluid is injected into the tube in such a manner that said bottom end is maintained permanently above the surface of the fluid in the tube.

7. A method according to claim 1, wherein the step 3 of welding of welding the bottom of the tube in part is performed by preheating the bottom of said tube, and then by means of jaws having central notches such that when the jaws are clamped to the bottom of said tube along its entire length, a small passage is left unwelded in the middle of said bottom.

8. A method according to claim 7, wherein during the step (5) of the method, air is sucked out from the tube via said passage left in the middle of the bottom of said tube which has been welded in part, after which said passage is, in turn, closed by welding.

9. A method according to claim 8, wherein said passage is welded between 1/10th of a second and 1 second after the commencement of air suction.

10. A method according to claim 8, wherein the passage is welded ultrasonically.

11. A method according to claim 8, wherein the passage is welded thermomechanically by heating the bottom of said tube prior to implementing the step (5) of the method.

* * * * *